United States Patent [19]

Rasmussen

[11] 4,080,117

[45] Mar. 21, 1978

[54] MULTI-CHAMBERED PUMP

[76] Inventor: Aaron P. Rasmussen, 9606 Candy La., La Mesa, Calif. 92041

[21] Appl. No.: 705,358

[22] Filed: Jul. 14, 1976

[51] Int. Cl.[2] ..... F04C 1/00; F04C 15/02

[52] U.S. Cl. ..... 418/77; 418/111; 418/188; 418/219

[58] Field of Search ..... 418/184, 186, 187, 188, 418/211, 219, 111, 77

[56] References Cited

U.S. PATENT DOCUMENTS

| | | | |
|---|---|---|---|
| 13,930 | 12/1855 | Wright | 418/186 |
| 857,558 | 6/1907 | Keenan | 418/77 |
| 2,901,978 | 9/1959 | Pelladeau | 418/219 X |
| 3,464,362 | 9/1969 | Ross | 418/219 X |
| 3,902,829 | 9/1975 | Burrowes | 418/219 X |

*Primary Examiner*—Carlton R. Croyle
*Assistant Examiner*—Leonard Smith
*Attorney, Agent, or Firm*—Charles C. Logan, II

[57] ABSTRACT

A multi-chambered self-priming rotary pump having a pair of eccentric cams, each in contact with opposite sides of a rotor plate at one point and positioned 180° out of phase so that the convex side of one cam is in direct opposition to a concave side of the other cam. At one point of contact on the convex curves, the cams bear against the side surfaces of the rotor which in turn forms a running seal with the bore of a housing to define two symmetrical enclosures at each side of the rotor. During rotation, a split core closure valve reciprocates between the surfaces of the cams and in so doing, the closure valve functions to produce an area of compression to the front of its travel with an area of vacuum to the rear of its travel. As one chamber phases out of cycle, its counterpart is producing maximum outputs. During rotation, a rotor impeller duct functions to pressure load the closure valve and provide impetus to the injection (clockwise rotation) or ejection (counterclockwise rotation) of pump fluids. The impeller duct is in communication with an annular housing duct which communicates with a housing fitting orifice. Completing the fluids cycle are shaft ports in communication with a ducted shaft which in turn communicates with a cam fitting orifice.

7 Claims, 7 Drawing Figures

Fig. 6
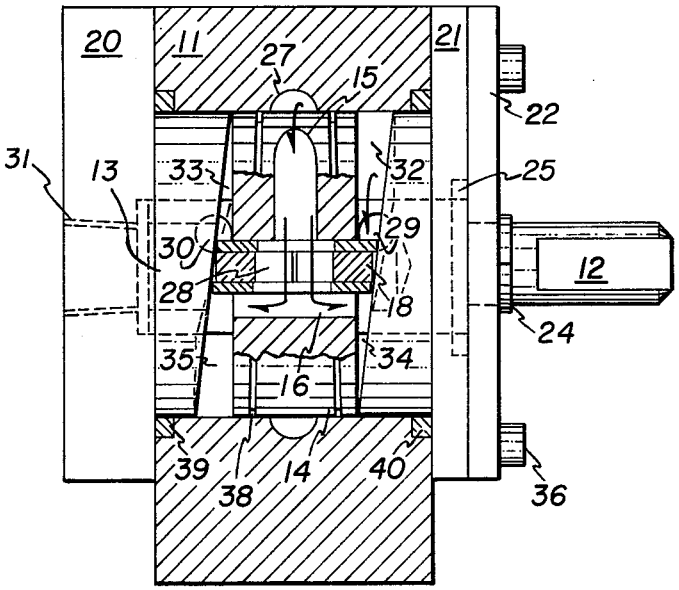
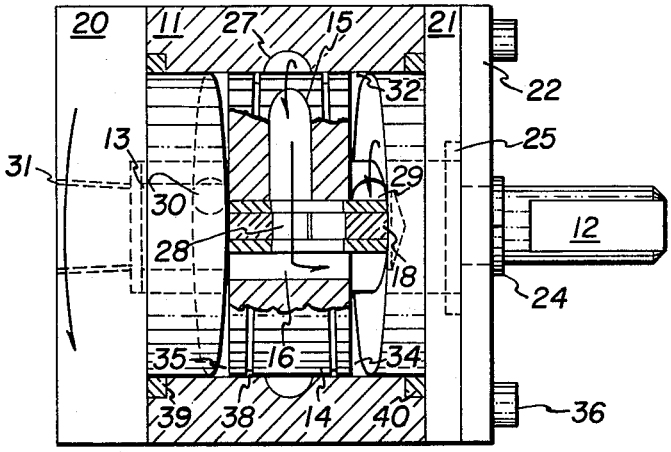
Fig. 7

MULTI-CHAMBERED PUMP

BRIEF DESCRIPTION OF THE INVENTION

The present invention relates to a multi-chambered pump of constant volume principle, but designed to incorporate centrifugal thrust in the delivery system. According to the invention, a self priming multi-chambered pump is provided for pumping fluids in either direction. A pump shaft drives an integral rotor plate between two eccentric cams. The cams are positioned 180° out of phase so that the convex side of the first cam is in direct opposition to the concave side of the other cam. Each cam bears against an opposite surface of the rotor plate at one area which in turn forms a running seal with a bore of the housing to define two symmetrical enclosures at each side of the rotor.

During rotation, a fluid pressurized closure valve reciprocates on the slightly convex and concave surfaces of the cams. In so doing, the closure valve functions to produce an area of compression to the front of its travel and a vacuum to the rear of its travel. As one chamber phases out of the intake exhaust cycle, its counterpart is in the process of producing maximum outputs.

The multi-chambered pump utilizes rotational forces to add impetus to the movement of fluids through the pump and to pressurize the closure valve seal at the cam surfaces. Assuming clockwise rotation, fluid routing follows a path from a housing fitting orifice to an annular housing groove. An off-center impeller duct milled in the concentric surface of the rotor plate rotatably picks up fluids from the annular housing duct and transfers them through the split half closure valve thereby activating pressure on the bearing surfaces of that valve. Finally, at the back of the valve, fluids forcibly inject the vacuum chambers of the pump. Forward of the closure valve, the compression chambers force fluids through shaft ports to a shaft core duct which in turn communicates with a cam block fitting orifice to permit the exit of exhaust fluids.

During counterclockwise rotation, the flow cycle is reversed and the impeller duct functions to centrifugally eject fluids from the compression chambers. Spiral grooves on the perimeter of the rotor plate provide additional compression seal. An integral system of shaft valving prevents pressure blow-by from compression to intake chambers. Shaft ports are located adjacent to the sides of the rotor so that the pitch configuration of the cams can function to open and close the ports during shaft rotation.

An object of the present invention, the multi-chambered pump, is to increase the priming and filling potential of constant volume pumps by impeller injecting the vacuum chambers.

Another object of the invention is to increase the delivery momentum and pressures of constant volume pumps through centrifugal evacuation of the compression chambers.

A further object of the invention is to provide fluid pressurization of the closure valve to improve the cam bearing seal of that valve, and to compensate for closure valve wear.

An additional object of the invention is the provision of an axial port valving system to reduce working parts and manufacturing costs.

Pump design features will be more easily understood when considered in connection with the following detailed description in which like reference numerals designate like parts throughout the Figures thereof and wherein:

FIG. 6 is a partially sectioned front view taken along line 2 of FIG. 1;

FIG. 7 is a sectioned view similar to FIG. 6 with a housing rotated counterclockwise 90°.

DETAILED DESCRIPTION OF THE DRAWING

Figure 1:
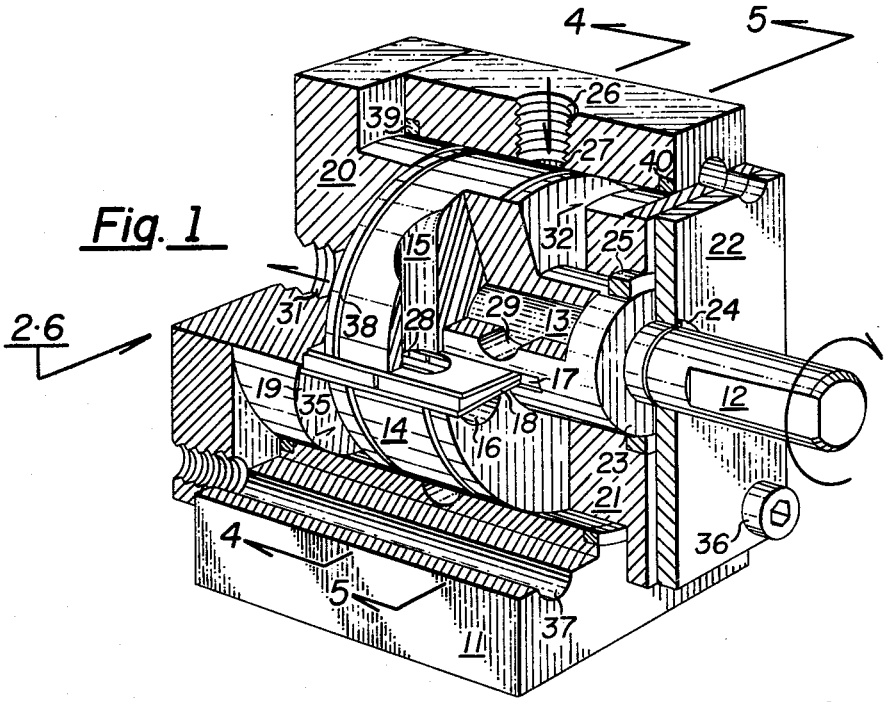
FIG. 1 is a perspective view, partially sectioned, of the preferred embodiment of the present invention.

Referring to FIG. 1, a bored housing 11 carries rotatable shaft 12 with core duct 13 and integral rotor plate 14. Rotor plate 14 carries impeller duct 15 and rotor channel 16. Sector slot 17 of rotor plate 14 carries a reciprocating closure valve 18. Closure valve 18 bears against eccentric surface 19 of cam block 20 and on the other side against the surface (not shown) of eccentric cam block 21. The contacting of eccentric cams 20 and 21 are geometrically formed so that the periphery of the eccentric face of each cam defines an elliptical plane and the edge of the axial bore in each cam defines an ellipitical plane. Any radial line between the two ellipses is at 90° to the axis of the pump. Retainer plate 22 resides between shaft shoulder 23 and retainer clip 24 to limit shaft end play. Packing gland 25 forms a seal with cam block 21 and shaft 12. O-rings 39 and 40 seal cam blocks 20 and 21 with housing 11.

A housing fitting orifice 26 communicates with annular housing duct 27 which is turn communicates with rotor impeller duct 15. Impeller duct 15 vents through duct 28 of closure valve 18 to communicate with rotor channel 16 which exits to both side of rotor plate 14. Shaft port 29 and shaft port 30 (not shown) communicate with rotor duct 13 which exhausts through cam fitting orifice 31 of cam block 20. Compression chamber 32 is shown ahead of closure valve 18 between rotor plane 14 and eccentric cam 21. Intake chamber 35 is shown behind closure valve 18 between rotor plate 14 and eccentric cam 20. Machine screw 36 passes through clearance hole 37 in retainer plate 22, cam block 21 and housing block 11 to thread into cam block 20. Four such screws assemble the pump.

Figure 2:
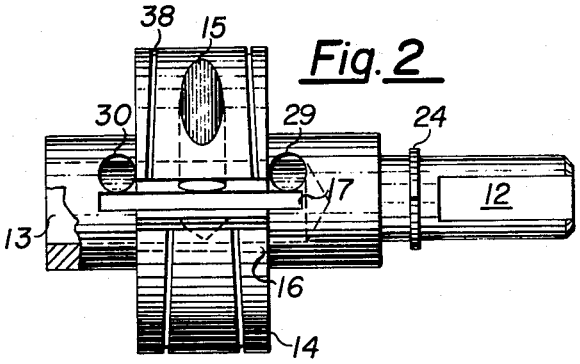
FIG. 2 is a front view of the rotor shaft and ducted core of the embodiment of FIG. 1 as seen from line 2 of FIG. 1.

Referring to FIG. 2, rotatable shaft 12 is shown carrying integral rotor plate 14 and retainer ring 24. Sector slot 17 has been machined at radial lines to the rotor axis to form a wedge shaped void in rotor 14. Rotor plate 14 displays impeller duct 15 bored to communicate with rotor channel 16. Channel 16 is semicircular and ducts to both sides of rotor plate 14. Shaft ports 29 and 30 communicate with core duct 13. Spiral groove 38 is shown as a helical recess on the perimeter of rotor plate 14.

Figure 3:
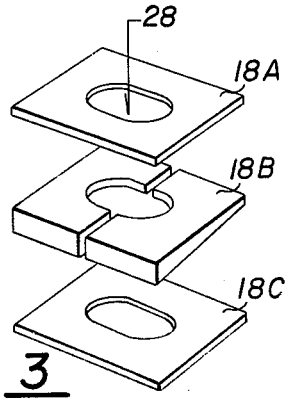
FIG. 3 is an exploded view of part 18, a three piece closure valuve.

Referring to FIG. 3, closure valve 18 shows split core 18B sandwiched between support plates 18A and 18C. Slotted duct 28 penetrates 18A, 18B and 18C.

Figure 4:
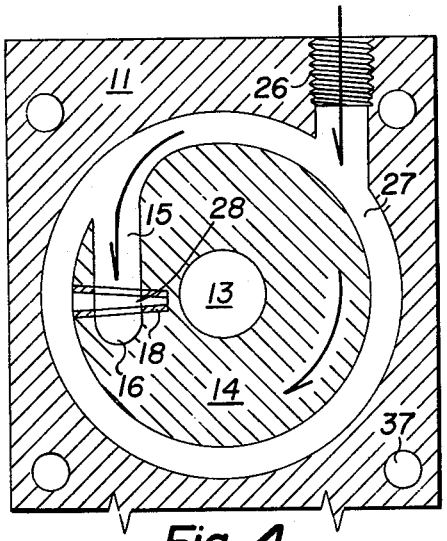
FIG. 4 is a cross sectional view taken along lines 4—4 of FIG. 1.

Referring to FIG. 4, sectioned housing 11 rotatable carries shaft rotor plate 14 and closure valve 18. Housing fitting orifice 26 communicates with annular housing duct 27 which in turn communicates with impeller duct 15. Impeller duct 15 vents through closure valve duct 28 to communicate with rotor channel 16.

Figure 5:
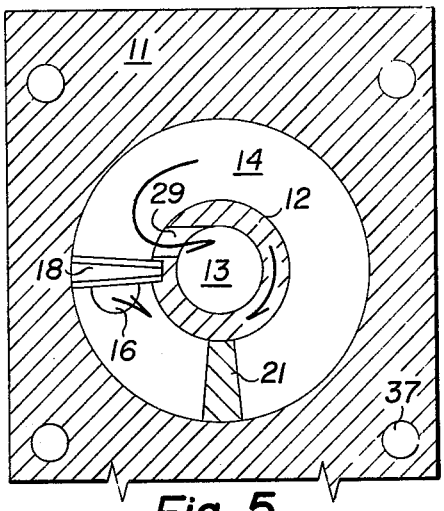
FIG. 5 is a cross sectional view taken along lines 5—5 of FIG. 1.

Referring to FIG. 5, bored housing 11 rotatably carries rotor plate 14 and closure valve 18. Rotor channel 16 is shown venting behind closure valve 18, and exhaust port 29 is shown in communication with duct 13 of rotor shaft 12. Cam block 21 is shown sectioned near the point at which it forms a running seal with rotor plate 14.

Referring to FIG. 6 and FIG. 7, housing 11 rotatable carries plate 14 which in turn carries closure valve 18. Closure valve 18 is in contact with the eccentric surfaces of cams 20 and 21. O-rings 39 and 40 together with packing gland 25 seal the unit. Annular housing duct 27 communicates with impeller duct 15 which vents through closure valve duct 28 to communicate with rotor channel 16. Rotor channel 16 communicates with intake chambers 34 and 35 at the rotor sides.

In FIG. 6, the eccentric face of cam block 21 and rotor plate 14 form compression chamber 32 separated from intake chamber 34 by closure valve 18. The eccentric face of cam block 20 and rotor plate 14 form compression chamber 33 which is separated from intake chamber 35 by closure valve 18.

In FIG. 7, the eccentric face of cam block 21 and rotor plate 14 form compression chamber 32 which is separated from intake chamber 34 by closure valve 18. The seal surface of cam block 20 bears at dead center against closure valve 18 to form a single continuous chamber 35 with rotor plate 14.

OPERATION

Assuming a clockwise rotation of pump shaft 12, fluids enter the pump housing at fitting orifice 26 which communicates with annular housing duct 27. During rotation of rotor plate 14, the fluids from duct 27 are rotatably forced into impeller duct 15 as shown in FIG. 4. The fluids then pass through a slotted duct 28 of closure valve 18. Pressure from the fluids act to spread split piece 18B of the closure valve shown in FIG. 3 thereby improving the chamber seal and compensating for closure valve wear. From duct 28, the fluids enter rotor channel 16, visible in FIG. 4 as a semicircle. Rotor channel 16 fills intake chambers 34 and 35 located to either side of the rotor plate as indicated in FIG. 6. In this manner, the vacuum chambers of the pump are rotationally charged with fluids. Spiral groove 38 as shown in FIG. 2 moves in a helical manner around the surface of the rotor during rotation to function as a compression seal.

Compression and intake chambers of the pump are formed as the reciprocating closure valve functions to limit chamber displacements at both sides of the rotor. In FIG. 7, housing 11 has been rotated counterclockwise 90° from FIG. 6 to demonstrate the effect of shaft rotation on chamber functions and closure valve position. In FIG. 6, intake chambers 34 and 35 are filling. Simultaneously, compression chambers 32 and 33 at the front of the closure valve are emptying their contents into core duct 13 through shaft ports 29 and 30. Duct 30 is shown in communication with cam fitting orifice 31 which exits the housing. As further rotation diminishes the distance between the closure valve seal and the cam bearing surface, fluids will continue to exit both shaft ports until, as in FIG. 7, one of the chambers is fully emptied. In FIG. 7, chamber 33 no longer exists as such since the closure valve is now positioned at dead center against the rotor bearing surface of cam 20. It is also evident in FIG. 7 that the closure valve has moved fully to the right, following the pitch line of the cams, and that the bored axial surface of cam block 20 now functions to block shaft port 30 to prevent blowby of compressed fluids. Cam block 20 has completed its cycle and cam block 21 is at maximum output.

It is understood that rotation of shaft 12 in a counterclockwise movement results in a reversal of the flow cycle and changes the function of the rotor impeller duct. The impeller duct in counterclockwise rotation functions to centrifugally evacuate the compression chambers whereas the intake chambers revert to vacuum fill principles. Obviously, pump requirements dictate the direction of pump rotation. When priming requirements are of foremost importance, the vacuum chambers wil be impeller filled in clockwise rotation. Where exhaust impetus is required, centrifugal force will be used to help evacuate the exhaust chambers in counterclockwise rotation.

The multi-chambered pump described in this disclosure incorporates in its design but makes no inventive claim for the following design specifications;

A bored housing block having first and second eccentric cam blocks disposed at each end thereof;

A rotor rotatably mounted within said housing block and said eccentric cams, said rotor comprising a ducted core and a rotor plate, said rotor plate having first and second sides;

Said first and second eccentric cams being in contact with first and second opposite sides of said rotor plate, respectively, at contact areas 180° removed from each other;

A closure valve carried by said rotor plate and disposed between first and second inside surfaces of said first and second eccentric cams, respectively, and forming a seal therewith;

A cylindrical rotor shaft having bored ports at one side of said closure valve and immediately adjacent to either side of said rotor plate, said ports coupled with a core duct of the rotor shaft and with the displacement chambers of the pump, said shaft ports in axial contact with the pitch line configerations of a first and second cam block to effect opening and closing of shaft ports.

The foregoing disclosure relates to only a preferred embodiment of the invention, and is not intended to cover all changes and modifications of the example of the invention herein chosen, for the purposes of the disclosure, which do not represent departures from the spirit and scope of the invention.

The invention claimed is:

1. A multi-chambered self priming pump comprising:

a bored housing block having first and second eccentric cams disposed on each end thereof, said first and second eccentric cams each having a bore therethrough.

a rotor plate rotably mounted within said housing block on a rotor shaft that passes through the bores of said first and second eccentric cams, said rotor plate being disposed between said first and second eccentric cams and said rotor plate having first and second lateral sides and a ducted core, said first and second eccentric cams and being in contact with said first and second lateral sides of said rotor plate, respectively, at contact areas 180° removed from each other, closure valve means carried by said rotor plate and being disposed between inside surfaces of said first and second eccentric cams and forming a rotating seal therewith, said rotor plate having a channel passing through its width at a point eccentrically located from the axis of said shaft, and said rotor plate having impeller duct means directed inwardly from its outer surface in the manner of a chord along a path offset from the axis of said rotor plate and connected with said rotor plate channel 16 intermediate its ends, said channel extending from said first lateral side of said rotor plate to said second lateral side, said channel only being open at its opposite ends with the exception of the opening formed where the impeller duct means intersects said channel, said impeller duct means opening in the direction of rotor rotation functioning to produce direct frontal injection of fluid into the pumps intake chambers when said rotor plate is rotated.

2. A multi-chambered, self priming pump as recited in claim 1 further comprising a pair of spiral grooves on the outer peripheral surface of said rotor plate that wind helically inwardly and function as a compression seal.

3. A multi-chambered, self priming pump as recited in claim 1 further comprising a pair of shaft ports on opposite sides of said rotor plate that are in communication with the core duct of said shaft, said cam members being oriented with said shaft ports such that as said shaft is rotated, the cam members act upon interface with said shaft ports as a valve for the chamber formed between the rotor plate, the shaft, the cam member, and the bore of said housing block.

4. A multi-chambered, self priming pump as recited in claim 1 wherein said impeller duct vents through a duct of said closure valve means to communicate with said rotor plate channel.

5. A multi-chambered, self priming pump as recited in claim 4 wherein said closure valve means comprises a plurality of wedge-shaped members, each of said wedge-shaped members having planar operating surfaces with a radial orientation to the axis of said rotor and one of said wedge-shaped members being split whereby pressure from fluid passing through the closure valve means acts to spread the split pieces thereby improving the chamber seal and also compensating for closure valve wear.

6. A multi-chambered self priming pump as recited in claim 5 wherein said rotor plate and shaft have a wedge shaped sector slot into which closure valve means is positioned, said slot being wider axially then the width of said wedge-shaped members to allow for their reciprocating travel as the shaft is rotated.

7. A multi-chambered, self priming pump as recited in claim 6 wherein said slot is also sufficiently deep axially to allow said wedge-shaped members to travel radially outwardly to compensate for wear along the peripheral surface of said wedge-shaped members.

* * * * *